US005495261A

United States Patent [19]

Baker et al.

[11] Patent Number: 5,495,261

[45] Date of Patent: Feb. 27, 1996

[54] ANTENNA GROUND SYSTEM

[75] Inventors: William W. Baker, Zeeland; Daniel R. Meyers, Jenison, both of Mich.

[73] Assignee: Information Station Specialists, Zeeland, Mich.

[21] Appl. No.: 322,739

[22] Filed: Oct. 13, 1994

Related U.S. Application Data

[63] Continuation of Ser. No. 109,408, Aug. 19, 1993, abandoned, which is a continuation of Ser. No. 708,183, May 31, 1991, abandoned, which is a continuation-in-part of Ser. No. 503,155, Apr. 2, 1990, abandoned.

[51] Int. Cl.[6] ..... H01Q 1/48

[52] U.S. Cl. ..... 343/846; 343/848; 343/829

[58] Field of Search ..... 343/846, 847, 343/848, 829, 896, 897; H01Q 1/48

[56] References Cited

U.S. PATENT DOCUMENTS

| | | | |
|---|---|---|---|
| 1,001,228 | 8/1911 | Stokes et al. | 343/847 |
| 1,214,591 | 2/1917 | Reuthe | 343/847 |
| 1,640,929 | 8/1927 | Farkouh | 343/897 |
| 2,193,859 | 3/1940 | Buschbeck | 343/848 |
| 2,501,430 | 3/1950 | Alford | 343/897 |
| 3,048,845 | 8/1962 | Becker | 343/848 |

FOREIGN PATENT DOCUMENTS

| | | | |
|---|---|---|---|
| 246444 | 10/1925 | United Kingdom | 343/897 |
| 1268344 | 3/1972 | United Kingdom | 343/846 |

OTHER PUBLICATIONS

Balanis, Antenna Theory Analysis and Design, Published by Harper & Row, New York, 1982 pp. 346–347.

Moxon, "HF Antennas For All Locations, published by the Radio Society of Great Britain", 1984, pp. 43–45 and 154–157.

*Primary Examiner*—Michael C. Wimer

*Attorney, Agent, or Firm*—Price, Heneveld, Cooper, DeWitt & Litton

[57] ABSTRACT

A shortened electrical grounding system for use with a vertical antenna, particularly AM limited range information stations. The grounding system has a plurality of fractional wavelength electrically conductive members joined together and connected to the electrical ground of the transmitter associated with the antenna. The fractional wavelength electrically conductive members can be made of wire or metal panels both of which can be fanned out about the base of the vertical antenna in a substantially circular pattern. The electrical grounding system can be buried in the ground or can be used above ground as a counterpoise. The electrical conductors making up the ground system can also be incorporated into a mat made of plastic or other suitable material which can be positioned at the base of the vertical antenna.

28 Claims, 2 Drawing Sheets

ANTENNA GROUND SYSTEM

CROSS-REFERENCE TO RELATED APPLICATION

This is a file wrapper continuation of application Ser. No. 08/109/408, filed Aug. 19, 1993 (now abandoned), which is a file wrapper continuation of application Ser. No. 07/708, 183, filed May 31, 1991 (now abandoned), which is a continuation-in-part of application Ser. No. 07/503,155, filed Apr. 2, 1990 (now abandoned).

BACKGROUND OF THE INVENTION

It is common practice in the installation of AM broadcast stations to put in an extensive ground system buried in the earth. In fact, the Federal Communications Commission (FCC) has mandated that each standard AM broadcast station be equipped with a ground system consisting of at least 120 radials, each being at least one-quarter wavelength in length. For the typical broadcast frequencies of 550 Khz to 1,600 Khz, this amounts to approximately 18,000 to 49,000 feet of wire which would occupy approximately 2 to 15 acres of clear land. The ground system for the typical AM broadcast antenna can be seen to be a very expensive and large undertaking.

The traveler's information AM broadcast stations, which are frequently seen at the entrances to airports, state parks, national parks and even at state borders, operate at a frequency of approximately 530 Khz and 1,610 Khz, which is slightly below and slightly above the standard broadcast range of frequencies. The FCC has waived the above-mentioned ground system requirement for traveler's information stations; however, a practical station still requires a ground system in order for the antenna to radiate an effective signal. The small, low power, limited range transmitters employed in the traveler's information service cannot justify the expense of the typical antenna ground system. Even the amount of land occupied by a conventional ground system at the authorized frequencies would be prohibitive.

SUMMARY OF THE INVENTION

In accordance with the present invention, a fractional wave length antenna ground system has been developed which enables low power, limited range AM traveler's information stations to produce an effective radiated signal substantially equivalent to that produced by a comparable transmitter and antenna equipped with a conventional ground system of 120 one-quarter wavelength radials. The fractional wavelength ground system employs radials which are only approximately 2% to 7% of the length of the length of a quarterwave radial at the operating frequency of the transmitter. For example, at 530 Khz one-quarter wavelength equals approximately 464 feet. In contrast, the radial used in the fractional wavelength ground system is approximately 9 to 10 feet in length. A full ground array at 530 Khz would occupy approximately 15 acres while the fractional wavelength ground system occupies a circular area approximately 18 to 20 feet in diameter. The ground system can be buried in the ground in the traditional manner about the base of the vertical transmitting antenna or, if the transmitting antenna is positioned on the roof of a building, the ground system can be positioned about the antenna base and function as a conventional counterpoise.

The electrical conductors making up the ground system can also be incorporated onto a mat made of plastic or other suitable material which can be positioned at the base of the vertical antenna.

DETAILED DESCRIPTION OF THE INVENTION

Figure 1:
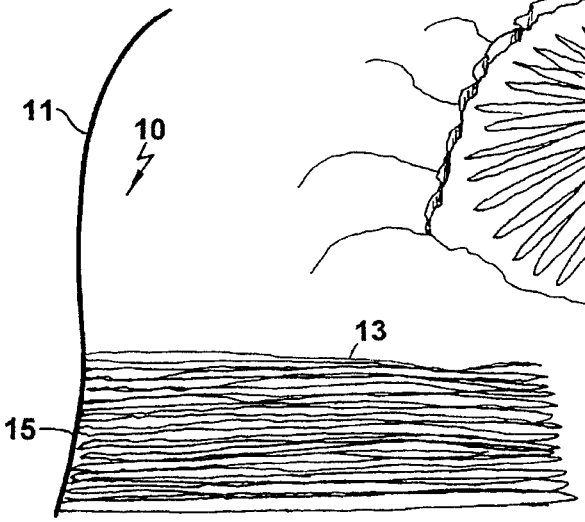
FIG. 1 is an elevational view of a fractional wavelength ground system showing the electrically connected individual ground members arrayed next to each other.

Referring to FIG. 1, one member of a ground system 10 is shown having a heavy gauge electrical conductor 11 which is used to connect the ground system to the AM transmitter and to the individual ground conductors 13. The electrical conductor 11 is preferably a heavy gauge stranded copper wire which provides a very low resistance path or connection to the individual ground members 13 which can also be used to dissipate a lightning discharge in the event of a strike. The preferred conductor is a No. 4 ASWG stranded wire. The electrical conductor 11 can be of random length so long as it is sufficiently long to reach from the ground conductors 13 to the transmitter installation at the base of, or slightly up on, the base of the vertical antenna.

In assembling the fractional wavelength ground member, approximately three feet of the wire 11 near one end is cleaned. A spool of, for example, No. 12 solid bare copper wire is then attached/preassembled by wrapping the wire once or twice about the cleaned portion of the heavy conductor 11 followed by brazing to hold it in place and to make a good electrical connection. The wire is then brought out to a pin or peg which is used as pattern for forming each individual loop and is then brought back and turned one and one-half times about the conductor 11 and braised at 15 before being again drawn out to the peg and brought back again. This process is continued until 100 to 150 discrete ground members in the form of continuous wire loops are prepared and braised to the end of the electrical conductor 11, which ground conductors 13 are positioned adjacent each other in a row along an end portion of the conductor 11 as shown in FIG. 1. In the preferred embodiment, each individual conductive member is a continuous loop approximately 9 to 10 feet long, 18 to 20 feet of conductor.

After all of the individual members are electrically connected in place, the portion 15 where all of the individual members are electrically connected to the conductor 11 is coated with a material such as a rubber coating or a liquid plastic to protect the area from corrosion. The assembly can merely be dipped into a shallow bath of the rubber or polymeric material and then allowed to dry. While No. 12 bare copper wire is preferred, other sizes and types of copper wire can also be used. If smaller wire is used, then great care must be exercised in handling the ground system to avoid breaking or stretching the wires. Also, if heavier conductors are used, the cost is significantly raised without a corresponding increase in electrical benefit. Other electrically conductive materials, for example aluminum, can be used but copper is preferred in view of its low cost and ease of soldering and brazing.

Figure 2:
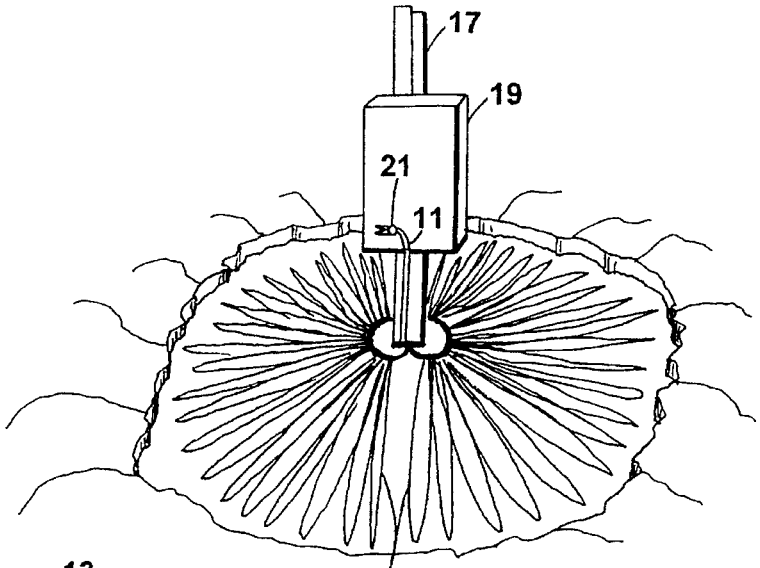
FIG. 2 is a schematic perspective view of two of the fractional wavelength ground systems of FIG. 1 fanned out in a circular pattern about the base of a vertical antenna with the conductors connected to the electrical grounding connection on a transmitter.

In FIG. 2, a portion of a preassembled antenna 17 is shown installed in the ground and extending vertically. An AM limited range transmitter 19 is mounted on the vertical antenna above the ground and the output of the transmitter is electrically connected to the antenna. The transmitter has an electrical ground connection 21 shown near the bottom of the cabinet. Two of the fractional wavelength electrical ground systems are disposed around the base of the vertical antenna with each being fanned out in the form of a "D" with the center of the straight, line at the back of each "D" being approximately centered at the base of the vertical antenna. As shown in FIG. 1, the loops of ground conductors 13 randomly contact one another. The pair of electrical, connecting wires 11 are brought up and joined to the ground connection 21 on the transmitter.

As shown in FIG. 2, a hole approximately 20 feet in diameter and 6–12 inches deep is dug about the base of the vertical antenna 17 The area of the circular pattern is calculated by the formula $A=\pi r^2$, where A=area, r=radius of the circular pattern, and $\pi$=a constant of about 3.14. Where the radius equals 10 feet (i.e., where the loops are about 10 feet long), the area equals about 315 square feet. One, or preferably 2, fractional wave length ground systems 10 are then fanned out in the hole to form a circular pattern about the base of the vertical antenna. The earth removed in the excavation can then be returned to the hole and leveled. The surface can be seeded if desired so that the ground system is not apparent. In some ground mounted antenna systems it is convenient to merely fan out the ground system about the base of the vertical antenna and then spread topsoil, or other covering material, over the ground system to conceal it and to protect it from damage.

Figure 3:
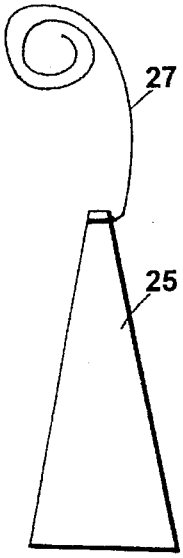
FIG. 3 is an elevational view of one ground member used in a second embodiment of the fractional wavelength ground system.
Figure 4:
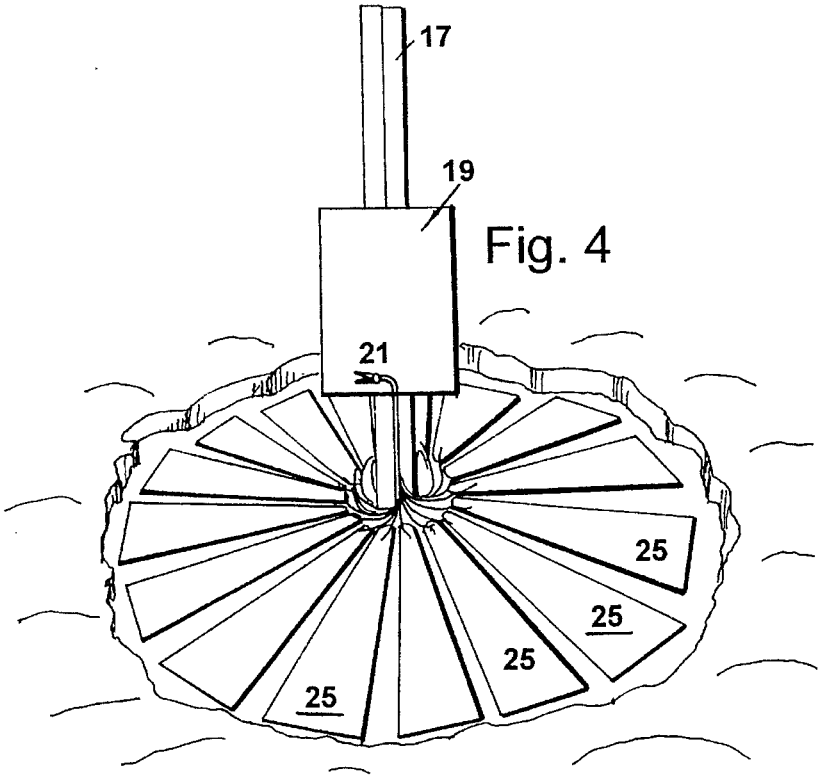
FIG. 4 is a schematic perspective view of a second embodiment of the fractional wavelength ground system arrayed in a circular pattern about the base of a vertical antenna with the central conductor being electrically connected to the ground of the transmitter.

Referring to FIG. 3, a portion of a second embodiment of a fractional wavelength ground system is shown in the form of an individual ground member 25 which comprises a sheet of metal approximately 9 feet long and 36 inches wide across the longer edge and approximately 4 inches wide across the shorter edge. An electrical conductor 27, similar to the conductor 11, is electrically connected near the short edge of the flat metal member 25. The preferred metal for use in manufacturing the second ground system is sheet steel approximately 10 gauge or smaller. Other conductive metal material can also be used, such as copper or aluminum. However, steel is preferred in view of its cost, physical strength and reasonable corrosion resistance. As shown in FIG. 4, the individual fractional wavelength ground members are preferably arranged in a circular pattern about the base of the vertical antenna 17 with each end of the individual pattern members electrically connected together by either combining all of the individual heavy gauge conductors 27 into a single heavy conductor or by joining the individual conductors 27 together and bringing a single conductor up from the ground system to the ground connection 21 on the transmitter 19. In installing the ground system of the second embodiment, it is preferred to use 16 wedge-shaped members 25 to form the overall ground system. As in the case of the wire loops shown in FIGS. 1 and 2, the ground system of FIGS. 3 and 4 can be buried below the surface, covered over after being arrayed on the surface or, if the installation requires, arrayed, for example, on the roof of a building in the form of a counterpoise.

Figure 5:
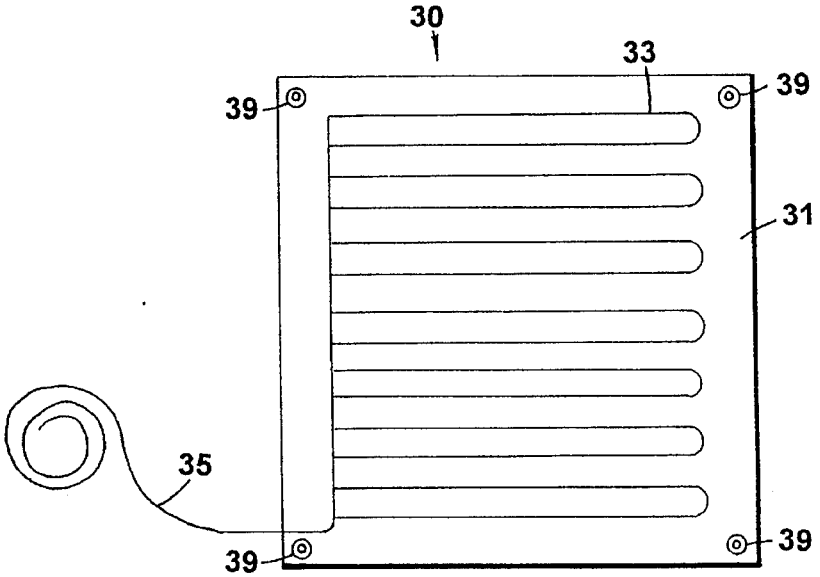
FIG. 5 is a diagrammatic view of a portable embodiment of a grounding system having the electrically conductive members on a mat.
Figure 6:
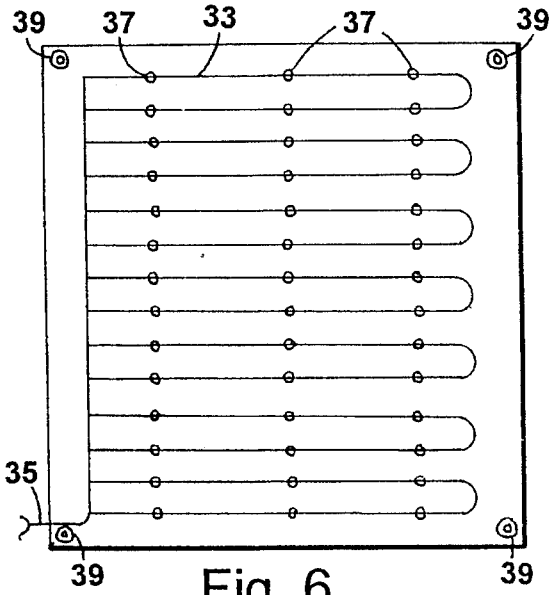
FIG. 6 is a view showing the electrically conductive members fastened to the mat by heat sealing or glue.
Figure 7:
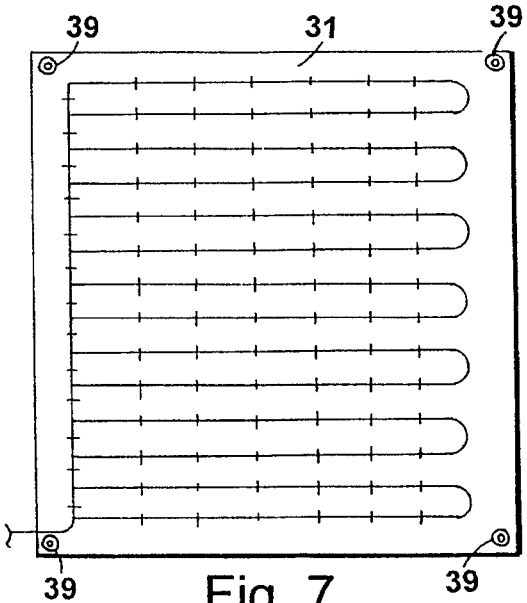
FIG. 7 is a view showing the electrically conductive members sewn to the mat.

A portable embodiment of the fractional wavelength ground system referred to generally by the number 30 is shown in FIGS. 5, 6 and 7. The portable ground system employs a sheet or mat of insulating material 31 upon which the electrically conductive members 33 are fastened. The mat is preferably made of an organic polymeric material such as polyvinyl chloride which is readily available in bulk film Or sheet form. The mat can also be made of fabric materials such as canvas, sail cloth and fiberglass. If the mat is made of a material such as a cotton fabric, it is preferred to treat the fabric with a waterproofing agent to impede absorption of water from contact with the ground. The waterproofing material also helps the fabric to dry quickly if wet.

The electrical conductors 33 can be made of bare or uninsulated copper in solid, stranded or braided form, the preferred material being braided copper wire.

The electrical conductor 35 which is used to connect the electrical conductor 33 to the transmitter can be the same as electrical conductor 11, that is, No. 4 ASWG. However, in line with the portability of the electrical ground system, the conductor 35 is preferably made of No. 12 ASWG stranded copper wire which is substantially lighter and more flexible.

A typical portable ground system can have a sheet of polyvinyl chloride approximately 10 feet by 10 feet. The sheet of polyvinyl chloride should be thick enough to withstand portable service and the environment in which it will be placed and also be thick enough to be dimensionally stable when the electrical conductor members are adhered to the sheet. The electrical conductor can be fastened to the mat with an adhesive material, heat sealing, stitching or any other convenient fastening technique. The preferred method for fastening the conductors in place is sewing, using an organic polymeric thread such as NYLON polymer. In FIG. 6, the electrical conductors 33 are fastened to the mat 31 by spaced bonding points 37 which can be formed by local softening of the polyvinyl chloride material or by the application of a suitable adhesive. In FIG. 7, the electrical conductors 33 are stitched to the vinyl mat.

Approximately 300 feet of electrical conductor is fastened to the surface of the 10×10 feet sheet of polyvinyl chloride. As mentioned previously, the preferred conductor is a copper braid material.

In operation, one or preferably two of the electrical grounding mats would be unrolled or unfolded and positioned adjacent to one another at the base of the vertical antenna. Under normal conditions the weight of the mat is sufficient to hold it in place. Grommet holes 39 are provided at each corner of the mat through which a suitable stake or rope can be passed to hold the mat in position.

The electrical grounding mats are particularly useful with special event information stations where a portable transmitter, antenna and grounding system can be quickly installed. The portable electrical grounding system is particularly useful since all of the electrical conductors forming the ground system are combined in one unitary assembly which is merely unrolled and laid out at the base of the antenna.

In order to prove the efficiency of the fractional wavelength ground system, a traveler's information station operating at 530 Khz was used. The field strength of the signal radiated by the antenna was measured in a full circular pattern approximately one mile away from the antenna site. The ground system for the station consisted of 16 100 foot radials buried in the ground about the base of the antenna. The ground system for the transmitter was then disconnected and a single fractional wavelength ground system, consisting of 108 10 foot elements, was installed and connected to the broadcast transmitter. Field strength measurements were again taken at the same distance, and in about the same pattern as the original tests and it was observed that the radiated signal was diminished only approximately 11%, leaving 89% of the effective radiated signal. This loss was extremely small and proved the effectiveness of the fractional wavelength ground system.

While the fractional wavelength ground system has been described in the environment of a traveler's information station, it is not so limited. The ground system can be used in other commercial services and should find significant use in the amateur radio service. Many radio amateurs live within the confines of cities and for that reason prefer a vertical antenna which occupies minimum space. For best performance, a vertical antenna should be associated with a substantial ground system. The radio amateurs have been forced to compromise by squeezing in as many ground radials as will fit on the city lot. The fractional wavelength ground system of the present invention would substantially improve the amateur radio grounding system.

Though the invention has been described with respect to a specific preferred embodiment thereof, many variations and modifications will become apparent to those skilled in the art. It is therefore the intention that the appended claims be interpreted as broadly as possible in view of the prior art to include all such variations and modifications.

The embodiments of the invention in which an exclusive property or privilege is claimed are defined as follows:

1. A preassembled electrical grounding system for a radio transmitter, transmitting signals in a frequency range between approximately 530 Khz and 1610 KHz at a low power for limited range traveler's information stations, and an associated vertical transmitting antenna comprising:

a connector including a first electrical conductor for connecting to said transmitter; and a plurality of grounding electrical conductors connected to said first electrical conductor, said connector and plurality of grounding electrical conductors forming a preassembled unit that is adapted to be spread out on the ground to provide a ground member around the vertical transmitting antenna with the antenna being substantially centered relative to said grounding electrical conductors, said grounding electrical conductors having a length of wire of less than 20 feet and extending generally radially outwardly from the base of the antenna, both ends of each said wire being connected to said first electrical conductor such that each said wire forms a loop and such that the entire grounding system for the antenna is confined to an area less than approximately 315 square feet when fully extended, some of said loops randomly contacting others of said loops, whereby the grounding system is provided in a substantially smaller area than that required for a grounding system having radials extending a length equal to a quarter wavelength of a 1610 KHz signal.

2. An electrical grounding system as set forth in claim 1 wherein said grounding electrical conductors include at least 25 one-piece, continuous radials of wire connected to said connector electrical conductor.

3. An electrical ground system as set forth in claim 2 wherein said ground electrical conductors are connected to form loops of wire forming a ground member with a radius of approximately 10 feet.

4. An electrical grounding system for use with a radio transmitter and associated vertical transmitting antenna as set forth in claim 1 wherein said grounding electrical conductors are connected at both ends to said connector electrical conductor to form loops, and each of said loops has a length such that the radius of said ground member is approximately 2%–7% of the length of a quarter wavelength at the operating frequency of the transmitter operating in the range of approximately 530 kHz and 1610 kHz.

5. An electrical ground system as set forth in claim 4 wherein the length of each loop of wire making up said ground member is approximately 2% of the length of a quarter wavelength at the operating frequency of said transmitter.

6. An electrical grounding system as set forth in claim 1 further including a mat of a flexible material supporting a plurality of individual one-piece, continuous planar loops of wire forming said ground member, which mat is positioned at the base of said vertical antenna to form a planar ground member.

7. A preassembled electrical grounding system as defined in claim 1 wherein said plurality of grounding electrical conductors are positioned adjacent each other in a row along a portion of said first electrical conductor during manufacture, but wherein said first electrical conductor and said plurality of grounding electrical conductors are sufficiently flexible and deformable to be fanned out around the vertical transmitting antenna during installation.

8. A preassembled electrical grounding system as defined in claim 1 wherein said first electrical conductor includes a first end section to which said plurality of grounding electrical conductors are connected, and further includes a transmitter-engaging second end section for connection to a ground for said transmitter.

9. A preassembled electrical grounding system as defined in claim 1 including a second preassembled flexible unit having a second connector for connecting to a ground of said transmitter and a second plurality of grounding electrical conductors attached thereto, said second plurality of grounding electrical conductors being adapted to be spread out around the antenna in a predetermined pattern with the first plurality of grounding electrical conductors, and with the second connector being connected to the ground of the transmitter.

10. A preassembled electrical grounding system for a radio transmitter for transmitting signals in a frequency range between approximately 530 kHz and 1610 kHz at a low power for limited range traveler's information stations, and an associated vertical transmitting antenna comprising:

a plurality of planar panels, each of said panels having a wide edge portion joined to a narrow edge portion by converging sides and when arrayed about said vertical antenna being laid out in a planar circular pattern with the narrow edge portion of each panel facing said vertical antenna and with each panel being physically separated from its adjacent panels, said panels having a length less than approximately 9 feet such that the grounding system is confined to an area less than approximately 315 square feet when fully spread out such that the grounding system has a substantially smaller radius than a quarter wavelength of the transmission signals transmitted by said transmitter; and an electrical conductor attached near the narrow edge portion of each of said panels for electrically interconnecting all of said panels and for electrically connecting all of said panels to said radio transmitter.

11. An electrical ground system as set forth in claim 10 wherein each of said panels is approximately 9 feet in length and approximately 3 feet across said wide edge.

12. A preassembled electrical grounding system as defined in claim 10 wherein said planar panels comprise metal panels.

13. A preassembled electrical grounding system as defined in claim 10 wherein said planar panels comprise mats of insulating material and a pattern of grounding electrical conductors fastened to said mats.

14. A method of providing a grounding system for an antenna used with a radio transmitter having a low power output for limited range traveler's information stations, and transmitting a signal having a frequency between 530 KHz and 1610 KHz, said method comprising the steps of:

preassembling a grounding system by providing a connector conductor for connection to the radio transmitter, by providing a plurality of grounding electrical conductors, and by connecting an end of said plurality of grounding electrical conductors to said connector conductor to form a preassembled unit;

coating the connecting locations of the grounding electrical conductors and the connector conductor with a rubber coating;

transporting the assembled grounding system to the location of the transmitter and antenna and connecting the connector conductor to the antenna; and deforming the connector conductor and also spreading out the preassembled unit including the grounding electrical conductors on the ground so that the antenna is substantially centered relative to the grounding electrical conductors with the grounding electrical conductors extending generally radially outwardly from the base of the antenna with some of the grounding electrical conductors contacting one another, said grounding electrical conductors each comprising a length of wire of approximately 20 feet or less, such that the grounding system for the antenna is confined to an area less than approximately 315 square feet when fully extended, whereby the grounding system is provided in a substantially smaller area than that required for a grounding system having radials extending a length equal to a quarter wavelength of a 1610 kHz signal.

15. The method as defined in claim 14, wherein said step of preassembling includes connecting grounding electrical conductors which are at least 25 one-piece continuous radials of wire connected to said connector electrical conductor.

16. The method of providing a grounding system as defined in claim 15, wherein said step of preassembling includes assembling the ground electrical conductors such that they form loops of wires forming a ground member with a radius of approximately 10 feet.

17. A method as defined in claim 14 wherein said step of preassembling includes positioning said plurality of electrical conductors adjacent each other in a row along a portion of said connector conductor.

18. A method as defined in claim 17 wherein said plurality of electrical conductors are positioned along an end portion of said connector conductor.

19. A method as defined in claim 17 wherein said step of spreading out said grounding electrical conductors includes fanning out said grounding electrical conductors from said row into an array.

20. A transmitter system including:

a transmitter transmitting signals in a frequency range between approximately 530 KHz and 1610 KHz at a low power for limited range traveler's information stations;

a vertical transmitting antenna coupled to said transmitter;

a connector including an electrical conductor connected to said antenna; and a plurality of grounding electrical conductors each including an end section pre-connected to said connector electrical conductor, said end sections and said connector electrical conductor forming a bendable and deformable assembly that can be readily handled and fanned out without breakage and without unacceptable stretching of the connector electrical conductor and the grounding electrical conductors and further that can be spread out on site to form a continuous ground member positioned on the ground with the antenna substantially centered relative to said grounding electrical conductors, and said grounding electrical conductors comprising a length of wire of less than 20 feet and extending generally radially outwardly from the base of the antenna such that the entire grounding system for the antenna is assigned to an area less than approximately 315 square feet when fully extended, whereby the grounding system is provided in a substantially smaller area than that required for a grounding system having radials extending the length equal to a quarter wavelength of a 1610 kHz signal.

21. The transmitter system as set forth in claim 20, wherein said grounding electrical conductors include at least 25 one-piece continuous radials of wire connected to said connector electrical conductor.

22. The transmitter system as set forth in claim 21, wherein said grounding electrical conductors are connected to form loops of wire providing a ground member with a radius of approximately 9 feet.

23. The transmitter system as defined in claim 22, wherein said grounding electrical conductors include a plurality of planar metal panels, each of said panels having a wide edge joined to a narrow edge by converging sides and when arrayed about said vertical antenna being laid out in a planar circular pattern with the narrow edge of each panel facing said vertical antenna and with each panel physically separated from its adjacent panel.

24. A method of providing a grounding system for an antenna used with a transmitter, comprising:

providing a first electrical conductor having an end section and a second section;

preassembling a plurality of grounding electrical conductors to said end section to form a first unit wherein said grounding electrical conductors are positioned generally parallel each other in a row along said end section;

transporting said unit to a location;

positioning said unit proximate the antenna and the transmitter;

deforming said first electrical conductor and simultaneously fanning out said plurality of grounding electrical conductors into a pattern around the antenna with some of said grounding electrical conductors contacting others of said grounding electrical conductors; and connecting the second section of the first electrical conductor to the transmitter to form a grounding system.

25. A method as defined in claim 24 including preassembling a second unit identical to said first unit, said second unit including a second electrical conductor and a second plurality of grounding electrical conductors connected to said second electrical conductor;

positioning said second unit proximate the antenna and the first unit;

deforming said second electrical conductor and simultaneously fanning out the plurality of grounding electrical conductors on said second unit to form a predetermined pattern with said first unit; and connecting the second electrical conductor of said second unit to one of said first electrical conductor and the transmitter.

26. A method as defined in claim 25 including, after said step of deforming and fanning out, covering said plurality of grounding electrical conductors so that said plurality of grounding electrical conductors are located underground in a protected position.

27. A preassembled electrical grounding system for a radio transmitter, and an associated vertical transmitting antenna comprising:

a connector including a first electrical conductor for connecting to said transmitter;

a plurality of grounding electrical conductors connected to said first electrical conductor, said connector and plurality of grounding electrical conductors forming a preassembled deformable unit that is adapted to be deformed, handled, and spread out on the ground in a generally circular arrangement to provide a ground member around the vertical transmitting antenna with the antenna being substantially centered relative to said grounding electrical conductors; and said plurality of grounding electrical conductors being positioned adjacent each other in a row along a portion of said first electrical conductor during manufacture, but wherein said first electrical conductor and said plurality of grounding electrical conductors are sufficiently flexible and deformable to be handled and fanned out around the vertical transmitting antenna during installation.

28. An electrical grounding system for a radio transmitter for transmitting signals in a frequency range between approximately 530 KHz and 1610 KHz at a low power for limited range traveler's information stations, comprising:

a vertical transmitting antenna;

at least two planar panels, each of said panels having a geometric shape and including a plurality of grounding electrical conductors attached to each of said panels and further including a connector conductor connected to said plurality of grounding electrical conductors, said connector conductor :including a portion extending from an edge of said panel, said at least two panels being arrayed about said vertical antenna in a planar generally circular pattern with said connector conductor of each panel facing said vertical antenna and with each panel being physically separated from its adjacent panels, said panels each having a shape of about 10 feet by 10 feet such that the grounding system is confined to a known area when fully spread out so that the grounding system has substantially smaller dimensions than a quarter wave length of the transmission signals transmitted by said transmitter; and said extending portions of said electrical conductors being operably connected to said radio transmitter for providing a grounding system therefor.

* * * * *